US006895732B2

(12) United States Patent
Sperry et al.

(10) Patent No.: US 6,895,732 B2
(45) Date of Patent: May 24, 2005

(54) PACKAGING APPARATUS AND METHOD

(75) Inventors: Laurence B. Sperry, Brighton, MA (US); Anthony O. Davlin, Cambridge, MA (US); Eric A. Kane, Lynn, MA (US); Jesse S. Drake, Belmont, MA (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 0 days.

(21) Appl. No.: 10/237,507

(22) Filed: Sep. 9, 2002

(65) Prior Publication Data

US 2004/0045261 A1 Mar. 11, 2004

(51) Int. Cl.[7] ..... B65B 43/04

(52) U.S. Cl. ..... 53/562; 53/553; 53/555; 53/370.5; 53/373.5; 53/375.8; 53/376.2

(58) Field of Search ..... 53/562, 553, 555, 53/370.4, 370.5, 373.2, 373.4, 373.5, 375.8, 376.2

(56) References Cited

U.S. PATENT DOCUMENTS

| | | | |
|---|---|---|---|
| 2,309,621 A | | 2/1943 | Allat |
| 2,340,260 A | | 1/1944 | Clunan |
| 2,525,651 A | | 10/1950 | Clunan |
| 2,597,042 A | | 5/1952 | Stokes et al. |
| 2,639,567 A | | 5/1953 | Murdoch et al. |
| 3,432,981 A | | 3/1969 | Minten |
| 3,432,988 A | | 3/1969 | Minten |
| 3,453,169 A | | 7/1969 | Buck et al. |
| 3,552,088 A | | 1/1971 | Niwa |
| 3,938,299 A | * | 2/1976 | Lerner ..... 53/434 |

(Continued)

FOREIGN PATENT DOCUMENTS

| | | |
|---|---|---|
| EP | 0 631 936 A1 | 1/1995 |
| GB | 1053915 | 1/1967 |
| GB | 1 206 163 | 9/1970 |

OTHER PUBLICATIONS

European Search Report; European Application No. EP 03 25 5586; Date Completed Mar. 31, 2004.

European Search Report; European Application No. EP 03 25 5586; Date Completed Dec. 11, 2003.

*Primary Examiner*—Scott A. Smith
*Assistant Examiner*—Brian D Nash
(74) *Attorney, Agent, or Firm*—Alston & Bird LLP

(57) ABSTRACT

A packaging apparatus includes a pair of rolls forming a nip through which two web portions are passed with an item to be packaged between the web portions. The rolls include resiliently compliant roll portions that deform to accommodate the thickness of the item, and the roll portions press the web portions to seal them together in peripheral regions surrounding the item and to center the item between the webs in the thickness direction. The apparatus also includes side seal devices that traverse inwardly toward the item to seal the webs together close to the item's opposite side edges to prevent the item from laterally shifting. The web portions may have cohesive disposed on their facing surfaces such that the web portions adhere to each other with pressure but tend not to adhere to the packaged item or other surfaces.

31 Claims, 9 Drawing Sheets

U.S. PATENT DOCUMENTS 3,991,540 A 11/1976 Ballestrazzi et al.
4,064,792 A 12/1977 Gess
4,074,505 A 2/1978 Keren et al.
4,085,560 A 4/1978 McClosky
4,319,443 A 3/1982 Watts, Jr.
4,369,613 A * 1/1983 Gess ..... 53/553
4,466,228 A 8/1984 Gess
4,498,575 A * 2/1985 Arfert et al. ..... 198/400
4,601,157 A 7/1986 Adelman
4,684,025 A 8/1987 Copland et al.
4,707,968 A * 11/1987 Vosters ..... 53/430
4,964,263 A 10/1990 Ballestrazzi et al.
5,057,169 A 10/1991 Adelman
5,160,377 A * 11/1992 Montemayor et al. ..... 118/13
5,165,221 A 11/1992 Udelson et al.
5,199,247 A 4/1993 Björkman et al.
5,269,122 A 12/1993 Reichental et al.
5,357,731 A * 10/1994 Conway et al. ..... 53/374.4
5,417,041 A * 5/1995 Hansen et al. ..... 53/550
5,444,964 A 8/1995 Hanagata
5,611,194 A * 3/1997 Wildmoser ..... 53/562
5,704,481 A 1/1998 Lutz
5,956,931 A 9/1999 Stork
6,016,639 A * 1/2000 Spencer ..... 53/230
6,145,283 A 11/2000 Noordenbos et al.
6,666,004 B2 * 12/2003 Hilbert et al. ..... 53/450

* cited by examiner

64'
70
72
90
78
80
74'
50
O
76
74
68
52
82
84
86
64
50a
52a

PACKAGING APPARATUS AND METHOD

FIELD OF THE INVENTION

The present invention relates to machines and methods for packaging items using flexible or semi-flexible sheet materials in continuous web form, wherein an object is disposed between two portions of sheet material and the two portions are sealed together about the periphery of the object to form a package that is then severed from the remainder of the web material.

BACKGROUND OF THE INVENTION

Flexible packaging has long been used to package products such as books, compact discs, cassette tapes, and a host of other types of items to provide protection when shipping or mailing the items, and in some cases to hermetically seal the objects from the outside environment. Web-handling machines have been developed to automate the process of packaging objects in flexible packaging materials. Dual-web machines bring a pair of webs into generally parallel confronting relation with each other and feed a product, or a group of products, between the webs. Longitudinal or side seals are then effected to seal the webs together along their side edges, and transverse or cross seals are similarly made ahead of and behind the packaged product(s), thus forming a package containing the product(s). The package is severed from the remainder of the webs to complete the process. Single-web machines work similarly, except a single web is either supplied to the machine as a C-fold, or a flat web is manipulated and folded into a C-fold configuration, the objects to be packaged are inserted between the two opposing portions of the C-folded web, and one longitudinal seal and two cross seals are formed.

Single-web machines typically include a longitudinal seal device such as a pair of rolls or the like forming a nip through which the overlying longitudinal edges of the opposing web portions pass to effect a longitudinal seal on one side of the package. Dual-web machines include a similar longitudinal seal device through which the opposite longitudinal edges of the web portions pass to effect an opposite longitudinal seal. The longitudinal seal devices can apply pressure alone where cold seal materials are employed, or can apply pressure and heat in the case of heat-seal materials. The longitudinal seal devices are spaced apart by a distance corresponding to the width of the web material. Typically this distance is fixed, such that the machine is able to handle only one width of material.

Generally there is an open space between the two longitudinal seal devices, and the object to be packaged passes through this space. One problem with such machines is that if the object to be packaged is considerably narrower than the space between the longitudinal seal devices, the object may be able to shift around within the resulting package. This is undesirable in many cases; for example, the object may be able to shift into a position close to one corner of the package and thus be more susceptible to being damaged if the package is dropped on the corner. Thus, such machines have disadvantages when it comes to packaging a variety of objects of different sizes and/or different shapes.

With conventional machines, another problem that frequently arises is that the packaged object is not centered between the two web portions in the thickness direction of the object, i.e., in a direction normal to the surfaces of the web portions. If the object is offset in the thickness direction toward one web portion, the frequent result is that the overlying longitudinal edges of the web portions are not properly aligned with each other; the edge (or both edges in the case of a dual-web machine) of the web portion toward which the object is offset tends to be pulled transversely inward toward the longitudinal centerline of the web portion because the web portion must curve outward to a greater extent than the other web portion. This results in package edges that are unsightly.

Another problem with many types of flexible packaging machines of the above-noted type is that the web materials tend to become wrinkled as a result of being forced to bend and curve by the contour of the object being packaged. In some cases, no attempt is made to eliminate the wrinkling, and the result is that packages are made that are not very aesthetically pleasing. The problem tends to become worse as the height or thickness of the packaged object increases, since the web material is forced to curve and bend to a greater extent. Furthermore, different types of web materials behave differently with respect to wrinkling. Therefore, the conventional machines are not well suited to packaging a variety of objects of different thicknesses, sizes, and shapes, since a machine set-up that may minimize wrinkling for one object configuration and/or one type of web material may not work well for a different object configuration and/or different web material.

Some machines are designed to be adjustable for different web widths in an attempt to address some of the above problems. For instance, the two spaced longitudinal seal devices in some machines are adjustable in position so they can be moved closer together when running a narrower web material for smaller objects, or farther apart when running a wider web material for larger objects. This approach, however, is unappealing because it complicates the design of the machine, and changing the machine set-up wastes time that could better be used producing packages. Furthermore, if the range and number of object configurations are substantial, it might be necessary to switch between several different widths of the same web material, which would be cumbersome, particularly if object configurations were changed frequently.

In light of the above considerations, a more versatile packaging machine and method are needed, able to handle various object configurations with a lessened need for hardware adjustments. Also needed is a packaging machine and method for producing packages with reduced wrinkling of the flexible packaging materials even when a change is made in the object configuration and/or type of packaging material. Moreover, there is a need for a packaging machine and method for producing packages that reduce shifting around of the packaged object and that provide improved corner protection; ideally, the machine and method would substantially center the packaged object in the thickness direction so that the overlying longitudinal edges of the web portions line up with each other.

SUMMARY OF THE INVENTION

The present invention addresses the above needs and achieves other advantages. In one aspect of the invention, an apparatus for packaging an item includes a pair of rolls that form a nip through which two opposing web portions pass with the item disposed between the web portions. At least one of the rolls has a resiliently compliant roll portion in registry with the item passing through the nip. The item deforms the resiliently compliant roll portion(s) as the item passes through the nip, and the restoring force of the compliant roll portion(s) causes the web portions to be pressed against the item so as to closely conform to the item's contour. The facing surfaces of the web portions present sealing material for sealing the web portions together; various types of sealing materials can be used, cohesive being one advantageous choice because of its propensity to adhere only to itself and its ability to adhere at non-elevated temperature. The web portions are sealed together about the periphery of the item, aided by the pressing action of the compliant roll portion(s). The resiliently compliant roll portions thus act to make the web portions as flat and smooth as the contour of the packaged item will allow, which helps reduce wrinkling of the web portions. The resiliently compliant roll portions may comprise a foam such as polyurethane foam. In one embodiment a foam cover surrounds a substantially rigid core or shaft of the roll. The foam cover can be a plurality of separate cylindrical segments arranged end-to-end such that the segments are independently deformable, or can be a single continuous foam cover. To substantially center the packaged object in the thickness direction, both rolls may have the resiliently compliant roll portion.

In one embodiment of the invention particularly suited for use with stiffer web materials such as paperboard or the like, opposite end portions of the rolls are relatively rigid. Thus, the roll has a central portion that is relatively compliant and opposite end portions that are relatively noncompliant or rigid. Two such rolls are in nipping engagement. The relatively rigid end portions form "hard" nips through which the opposite longitudinal edges of the web portions pass such that longitudinal edge seals are effected in the hard nips. In an alternative embodiment particularly suited for less stiff web materials such as polymer films or the like, one or both of the rolls can be resiliently compliant over the entire length, i.e., there are no hard nips for forming longitudinal edge seals.

The apparatus may include side seal devices for making side seals on either side of the packaged item and a cross seal device for making transverse cross seals ahead of and behind the item. The side seal devices may be operable to seal the web portions together at locations closely adjacent the opposite side edges of the packaged item (and spaced inwardly from the longitudinal edges of the web portions) regardless of the width of the item in relation to that of the web portions. In one embodiment, the side seal devices are operable to move transversely inward from the opposite longitudinal edges of the web portions toward the item being packaged until the side seal devices are at locations closely adjacent but spaced from opposite sides of the item. The side seal devices then seal the web portions together, whereby the item is prevented from shifting transversely toward either longitudinal edge of the web portions. This improves the edge or corner protection provided by the package.

The side seal devices in one embodiment comprise pairs of roller balls forming nips. One pair of balls is mounted on a carrier at one longitudinal edge of the web portions such that the web portions pass through the nip between the two balls; the other pair of balls is similarly disposed at the other longitudinal edge of the web portions. The carriers are driven inwardly and outwardly in the transverse direction by a traversing mechanism. The traversing mechanism is controlled to drive the side seal devices inwardly toward the packaged item as the web portions are advanced, thus pressing and sealing the web portions together. The inward advancement of the side seal devices is halted when the side seal devices are closely adjacent to but spaced from the side edges of the item.

In one embodiment of the invention, the proximity of the side seal devices to the item is determined based on the level of current supplied to an electric drive motor of the traversing mechanism. The current required to drive the motor increases as the side seal devices closely approach the item, and the advancement of the devices is halted when the current exceeds a threshold level. Alternatively or additionally, the advancement can be halted based on a detected transverse position of the side seal devices in relation to a predetermined width of the item. The side seal devices are retracted back toward the longitudinal side edges of the web portions as the web portions with the item therebetween continue to be advanced. Accordingly, an arcuate or hourglass-shaped side seal is formed on each side of the item, with the inward portion of the seal being close to the item. The item is thereby prevented from shifting transversely within the package to any significant extent.

Alternatively, the side seal devices can be set at fixed positions throughout the packaging operation so that linear side seals are made; the fixed positions of the side seal devices can be adjusted based on the width of the packaged object. For instance, an operator can enter the object width into a memory associated with a controller for the machine, and the side seal devices can be automatically moved via suitable drive mechanisms to the proper positions based on the entered width; alternatively, the machine can include a detector for sensing the object width, and the side seal devices can be positioned based on the detected width. It is also possible to manually adjust the positions of the side seal devices based on a known object width, although this is less preferred because of the requirement of human intervention.

A further aspect of the invention involves automatically adjusting the length of the packaging material that extends beyond the downstream or leading edge of the package and beyond the upstream or trailing edge of the package, as a function of the height of the packaged item. Generally, as the height of the item increases, it is desirable to increase the length of the leading-edge and trailing-edge portions of the package, referred to herein as the fin length; conversely, for items of less height, the fin length can be shorter. In accordance with one aspect of the invention, the packaging apparatus includes a height detector for measuring the height of the items being packaged. The apparatus includes a web supply and drive system for advancing the web portions, and a cut-off device for severing the web portions to form discrete packages. A controller coordinates operation of the cut-off device and the advancement of the web portions so as to cause the cut line along which the web portions are severed to be spaced from an adjacent edge of the item by a spacing distance that is proportional to the measured height of the item.

In accordance with still another aspect of the invention, the apparatus includes a cut-off device for severing a completed package from the web portions, and a safety system including a detector for detecting presence of any foreign object in the path of the cut-off device. The safety system is operable to disable the cut-off device upon the detector detecting any such object. The detector preferably measures the total thickness of the web portions plus any foreign object, if any, that is present adjacent the location where the cut-off device is to sever the web portions. If the measured thickness exceeds the predetermined thickness of the web portions by more than a predetermined amount, this is indicative of a foreign object being present, and the safety system disables the cutoff device. Alternatively, the detector can be a discrete switch such as a proximity switch or reed switch associated with a member that is moved against the web portions at a location adjacent the cut-off device; the discrete switch enables the cut-off device only when the member reaches a position indicating that no foreign object is present to block its movement.

The cut-off device may include a cutting member (e.g., a blade, knife, shear bar, or the like) that extends across the width of the web portions and is advanced to sever the web portions. A guard assembly shields the cutting member to prevent access to the cutting member when the cutting member is in its retracted position.

The apparatus may include a quick-change mounting system for mounting supply rolls of web material. The quick-change mounting system includes a core shaft configured to be inserted into and engage a core of a supply roll such that the supply roll is constrained to rotate with the core shaft. An end of the core shaft has a brake wheel mounted thereon for rotation with the shaft. The system includes a receptacle for receiving and rotatably supporting the brake wheel and has a brake shoe that is urged against the brake wheel by a clamp so as to resist rotation of the supply roll and thereby control draw-off tension of the web. The clamp includes a quick-release latch. The clamp is adjustable to adjust the clamping force and hence the draw-off tension, and the latch can be opened and closed without changing the adjustment. Thus, a new supply roll can be installed without having to readjust the draw-off tension setting.

BRIEF DESCRIPTION OF THE DRAWINGS

Figure 1:
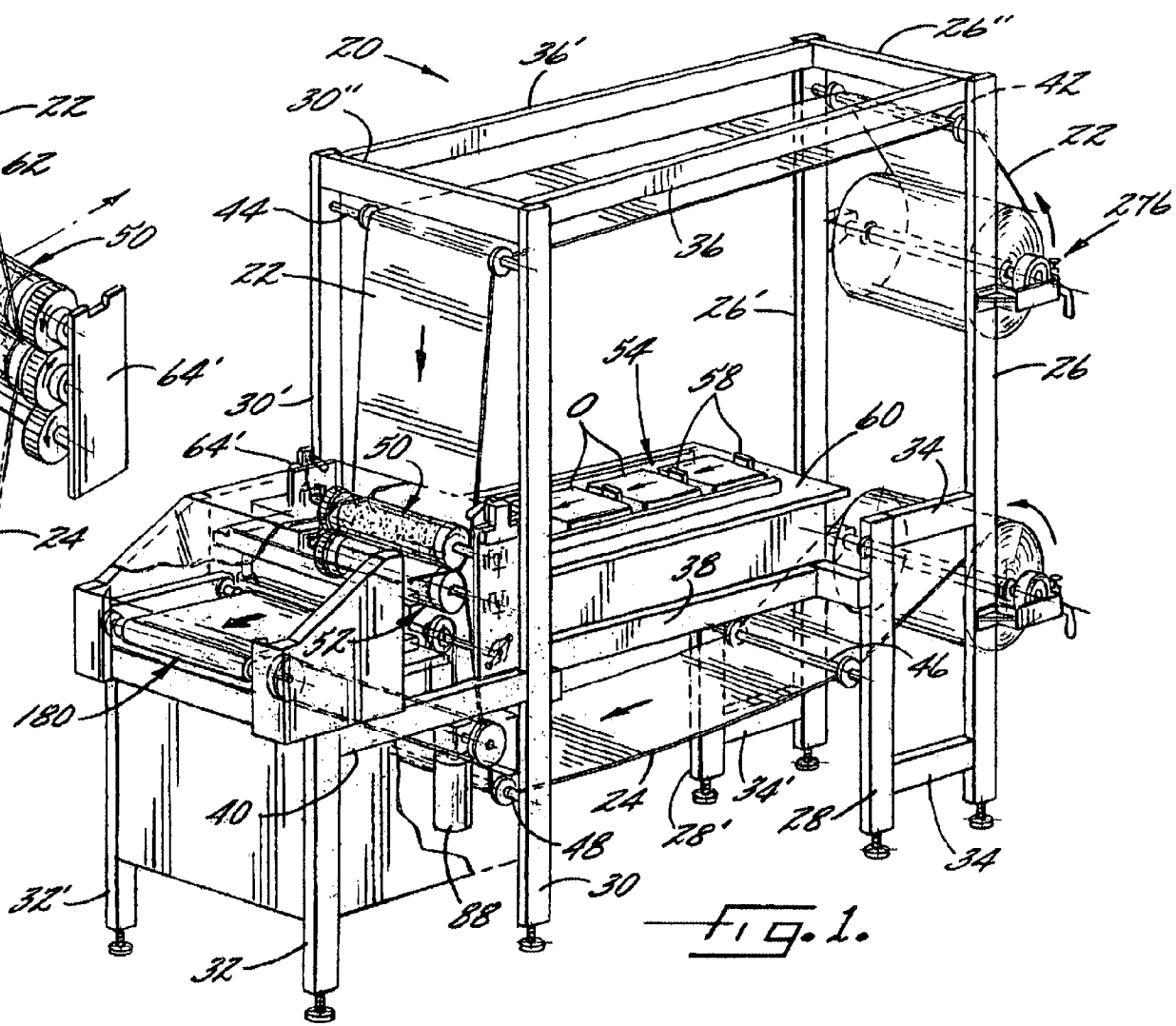
Figure 2:
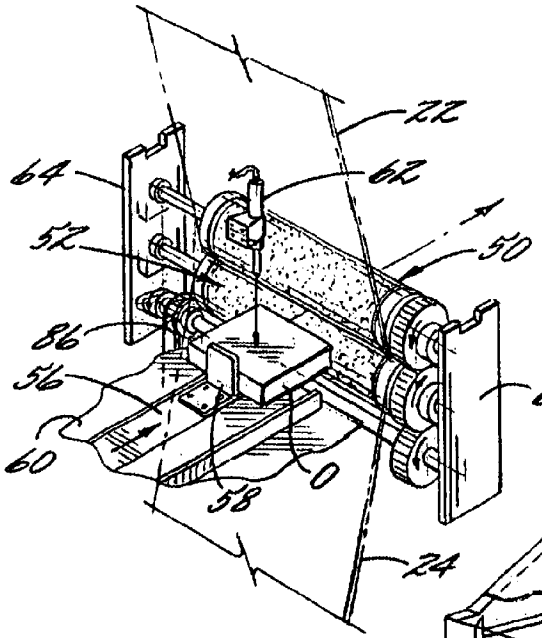
Figures 3, 4:
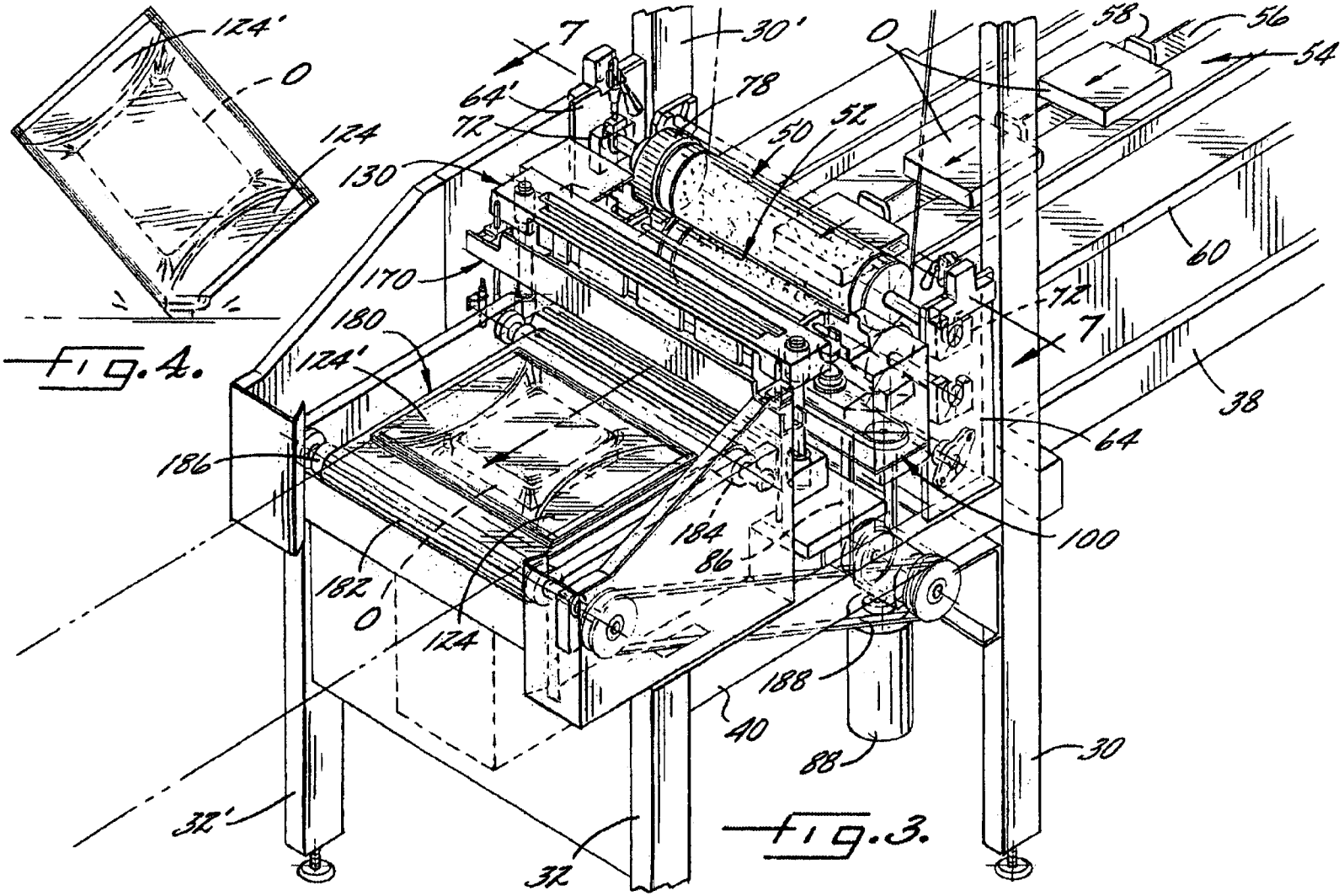
Figures 5, 6:
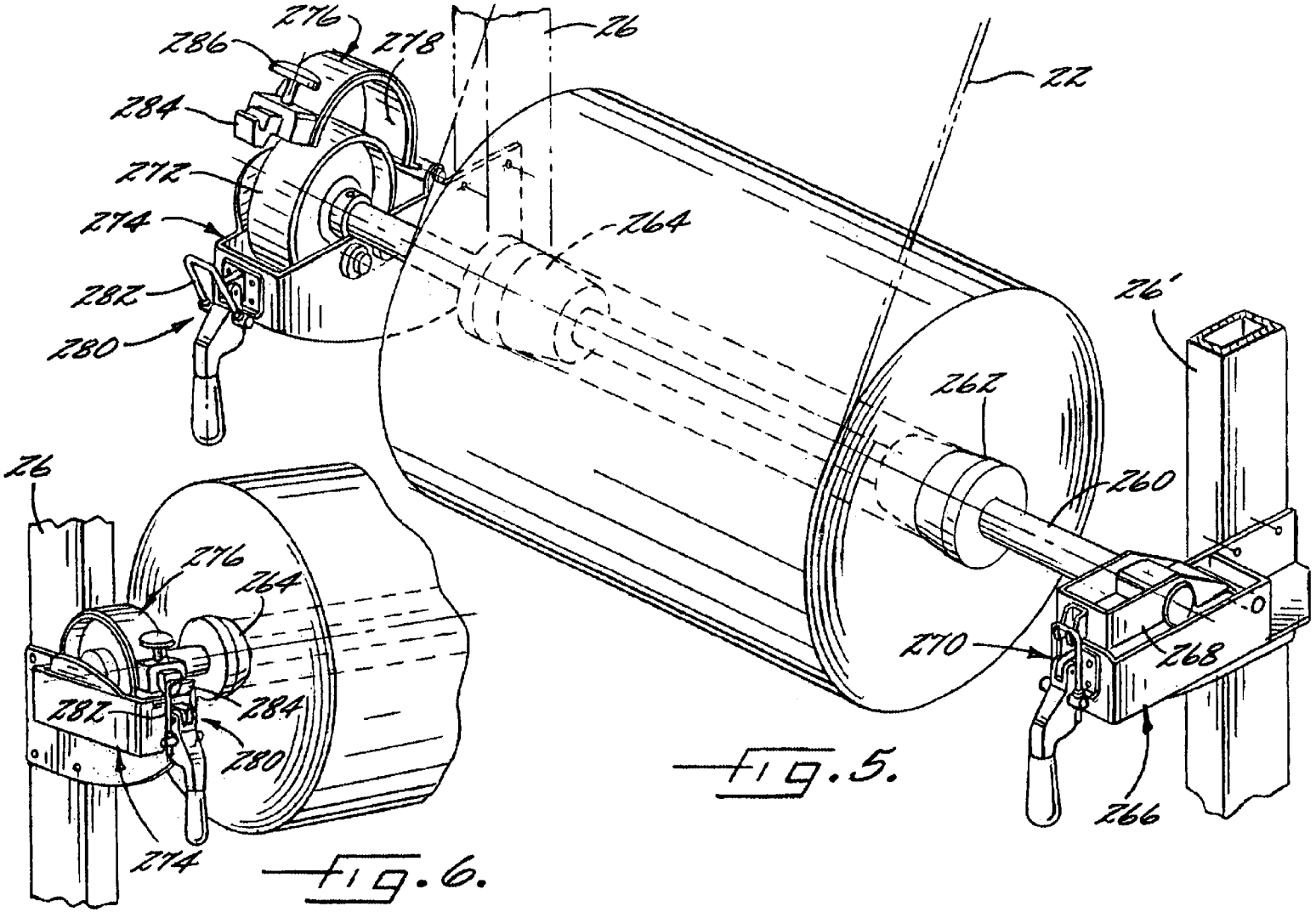
Figures 7, 8:
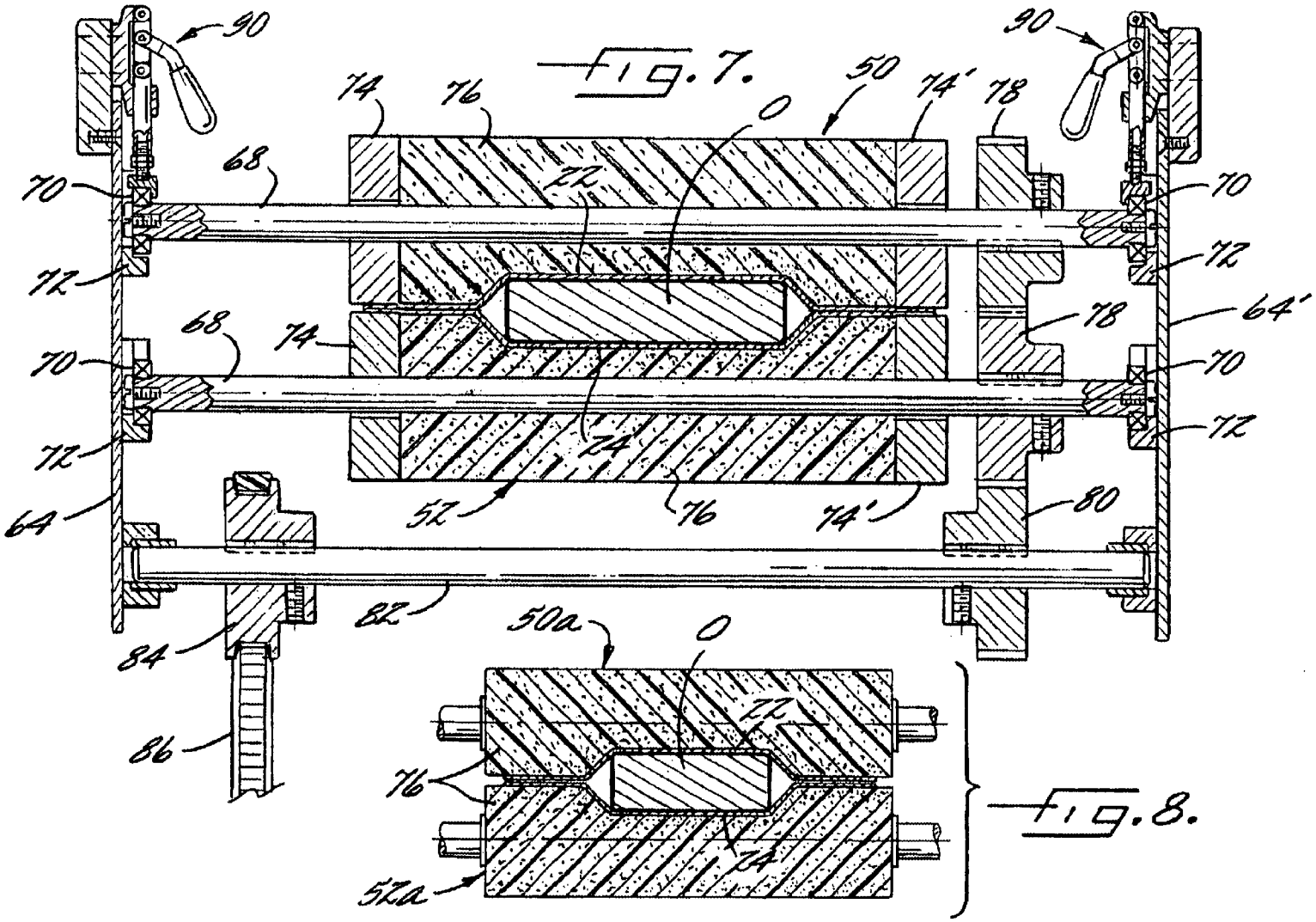
Figure 9:
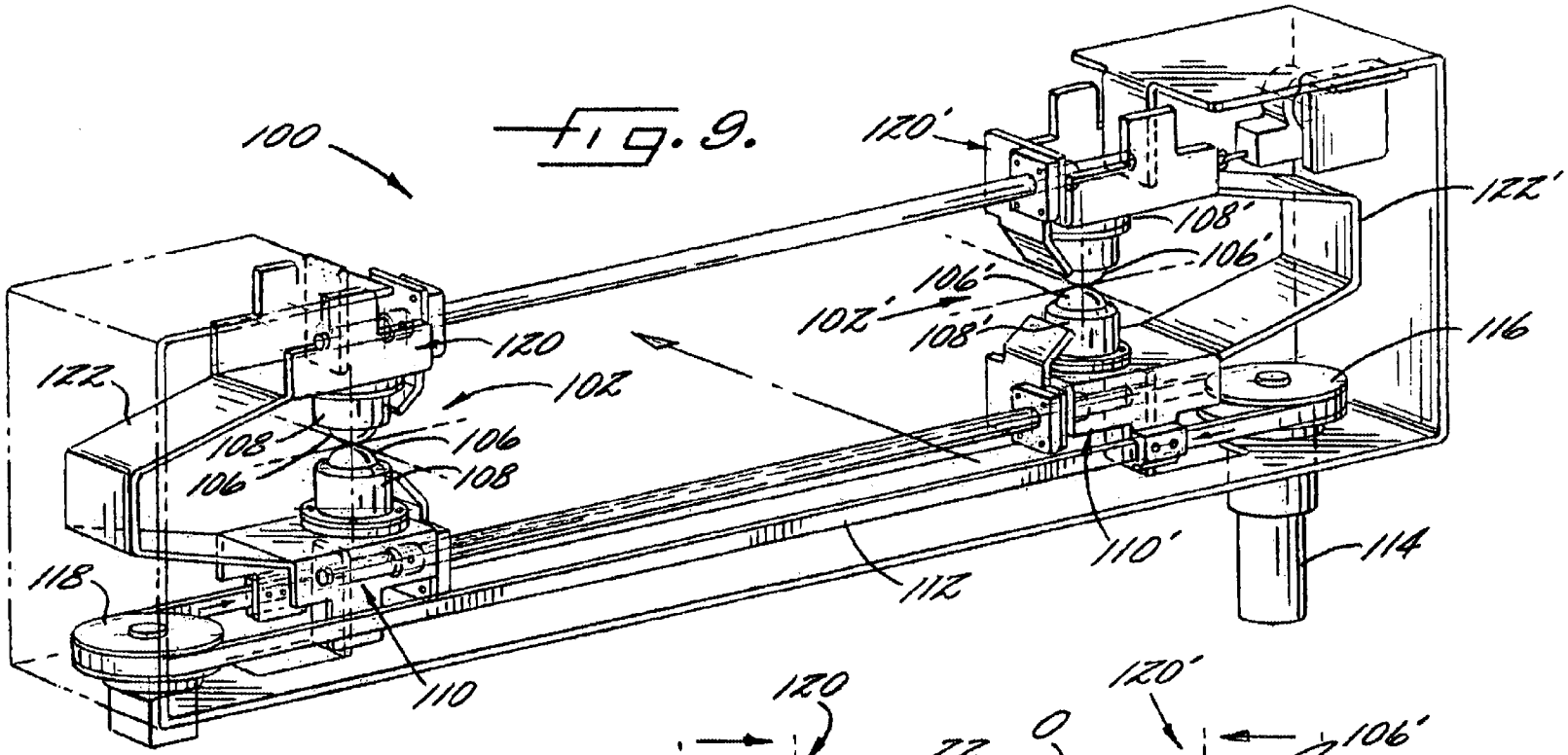
Figure 11:
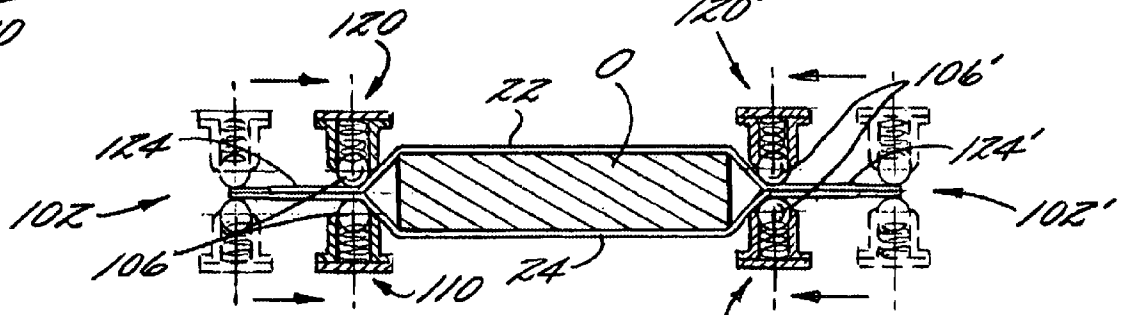
Figure 10:
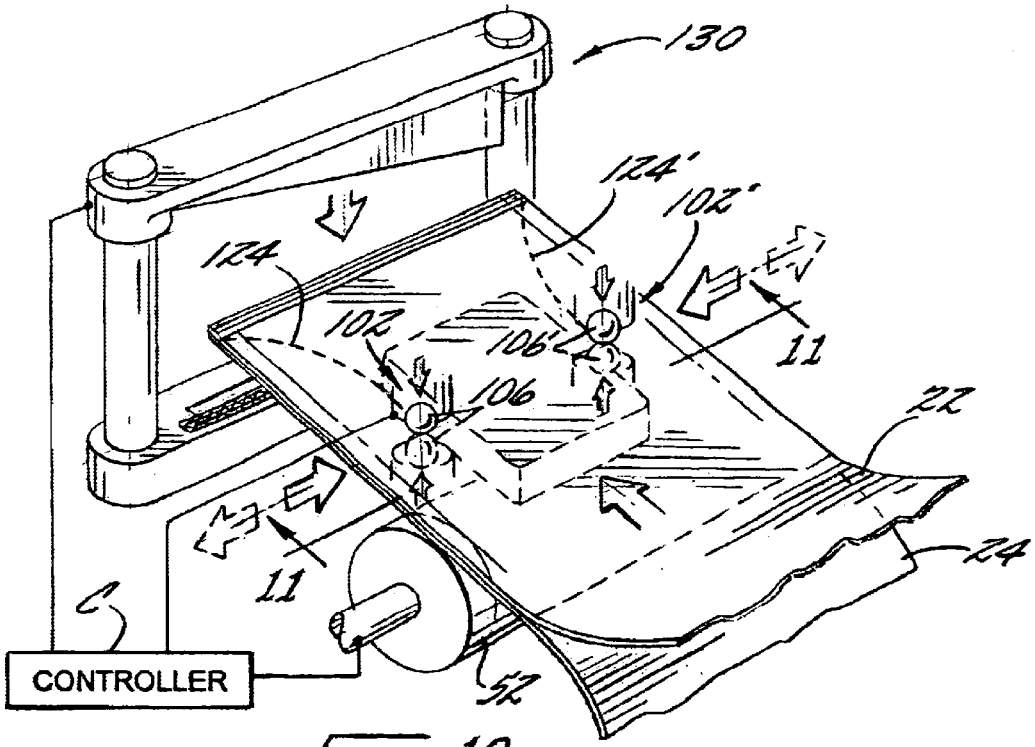
Figure 12:
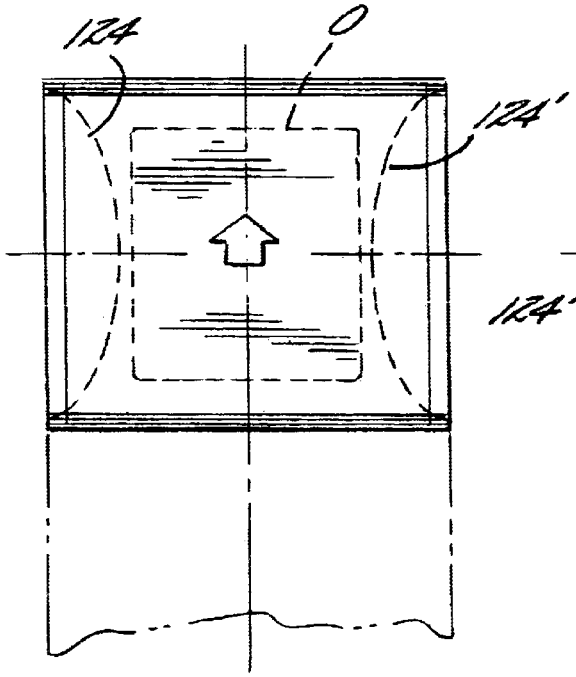
Figure 13:
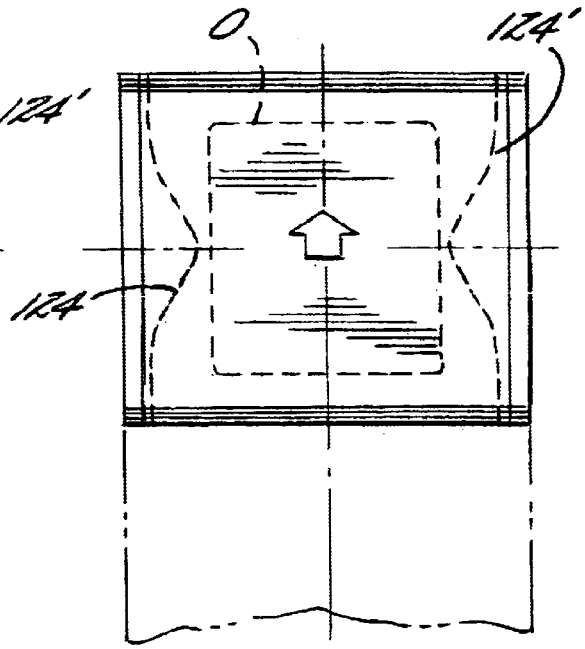
Figure 14:
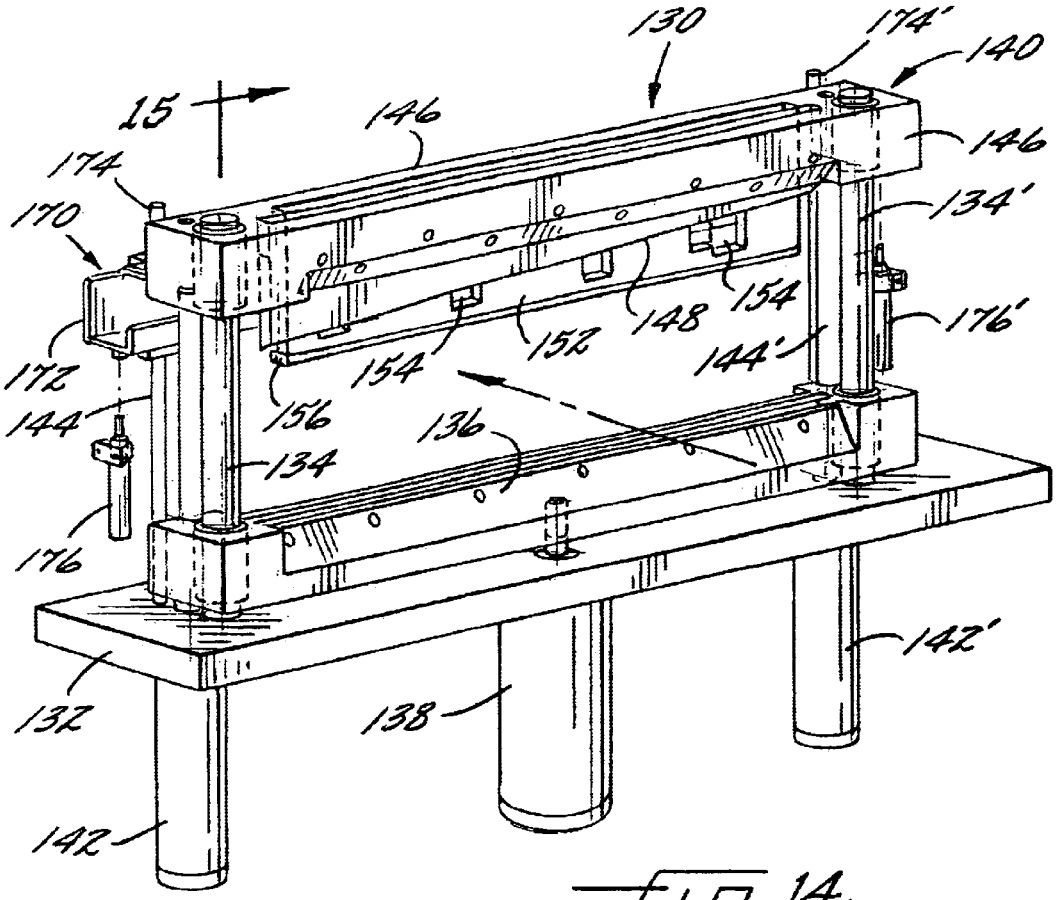
Figure 17:
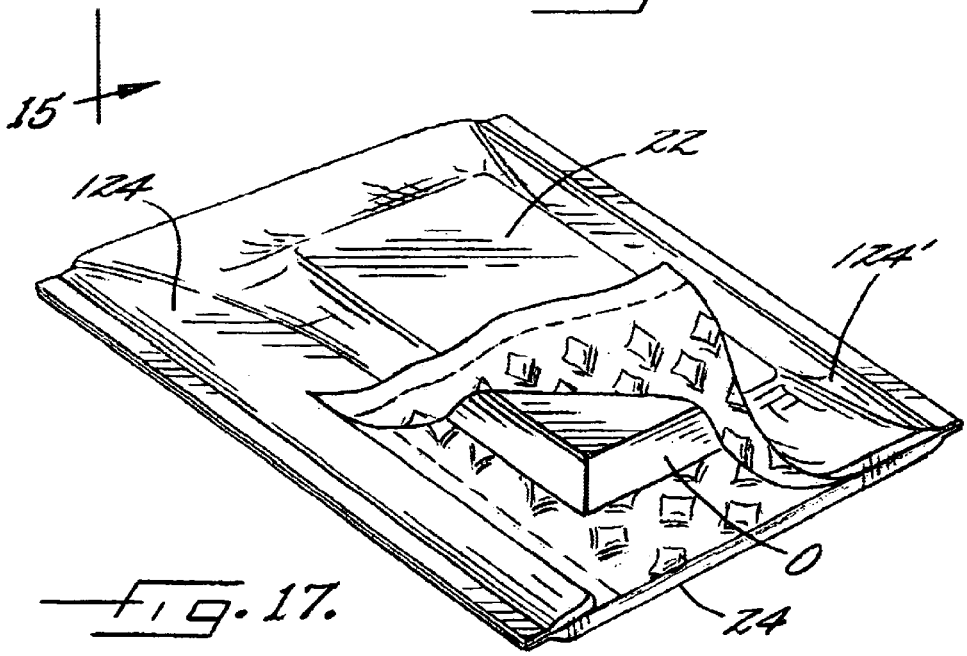
Figures 15, 16:
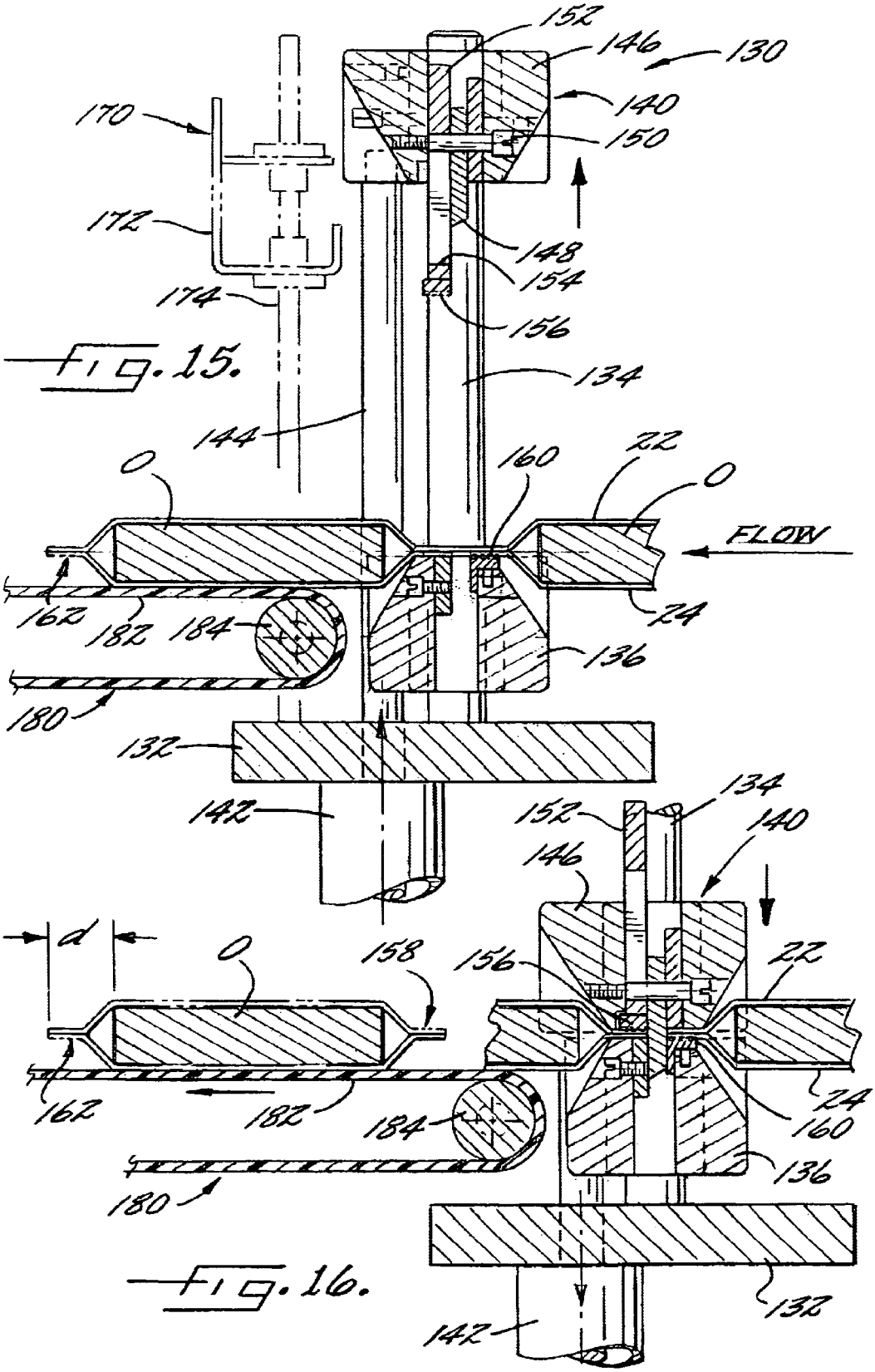
Figure 18:
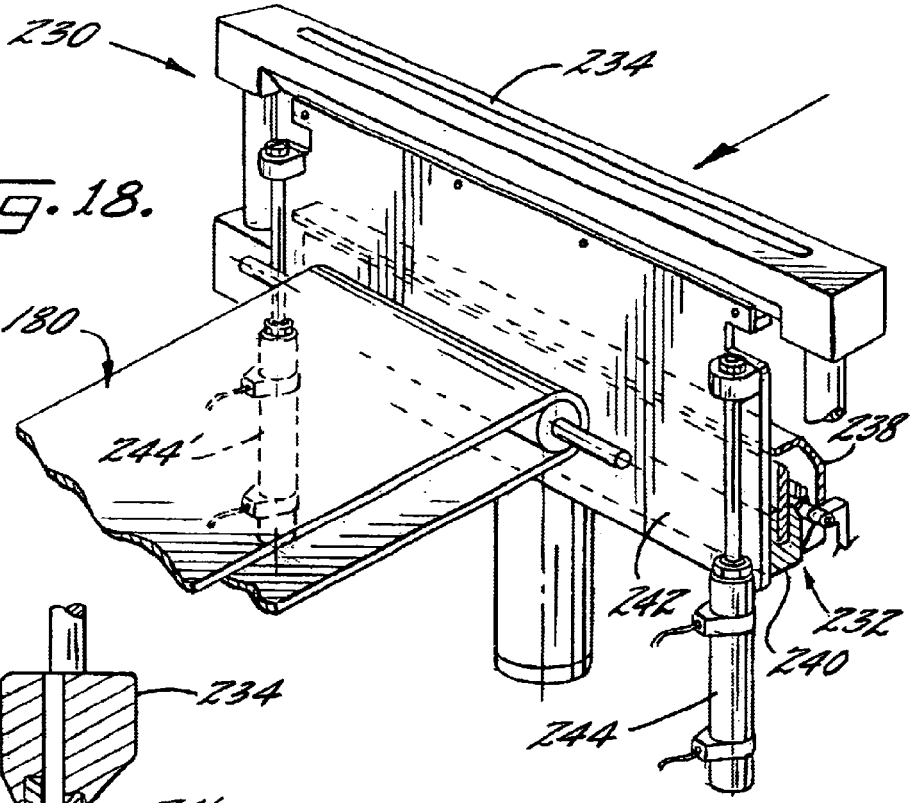

Having thus described the invention in general terms, reference will now be made to the accompanying drawings, which are not necessarily drawn to scale, and wherein:

FIG. 1 is a perspective view of one embodiment of a packaging apparatus in accordance with the invention;

FIG. 2 shows an object at an infeed station of the apparatus being fed into a nip between the opposed rolls along with a pair of webs of packaging material;

FIG. 3 shows the outfeed end of the apparatus and a finished package being discharged therefrom;

FIG. 4 illustrates a completed package being dropped on a corner;

FIG. 5 depicts a mounting arrangement for a supply roll of packaging material, showing a brake clamping device in an open position;

FIG. 6 shows the brake clamping device in a closed position;

FIG. 7 is a cross-sectional view taken on line 7—7 of FIG. 3 through the opposed rolls of the apparatus;

FIG. 8 is a view similar to FIG. 7, showing an alternative embodiment of opposed rolls in accordance with the invention;

FIG. 9 is a perspective view of an arrangement for making side seals in accordance with the invention;

FIG. 10 shows the side seal arrangement forming side seals in the packaging material as it exits the nip of the opposed rolls;

FIG. 11 is a cross-sectional view along line 11—11 of FIG. 10;

FIG. 12 is a top view of a package showing one configuration of side seals that can be made in accordance with the invention;

FIG. 13 is a view similar to FIG. 12 showing an alternative configuration of side seals;

FIG. 14 is a perspective view of a cut-off device of the apparatus;

FIG. 15 is a cross-sectional view through the cut-off device along line 15—15 of FIG. 14, showing the cut-off device in an open position;

FIG. 16 is a view similar to FIG. 15, showing the cut-off device in a closed position for severing a package from the remainder of the packaging material webs;

FIG. 17 is a perspective view of a package made in accordance with the invention, partially opened;

FIG. 18 shows an alternative embodiment of a cut-off device; and

Figure 19:
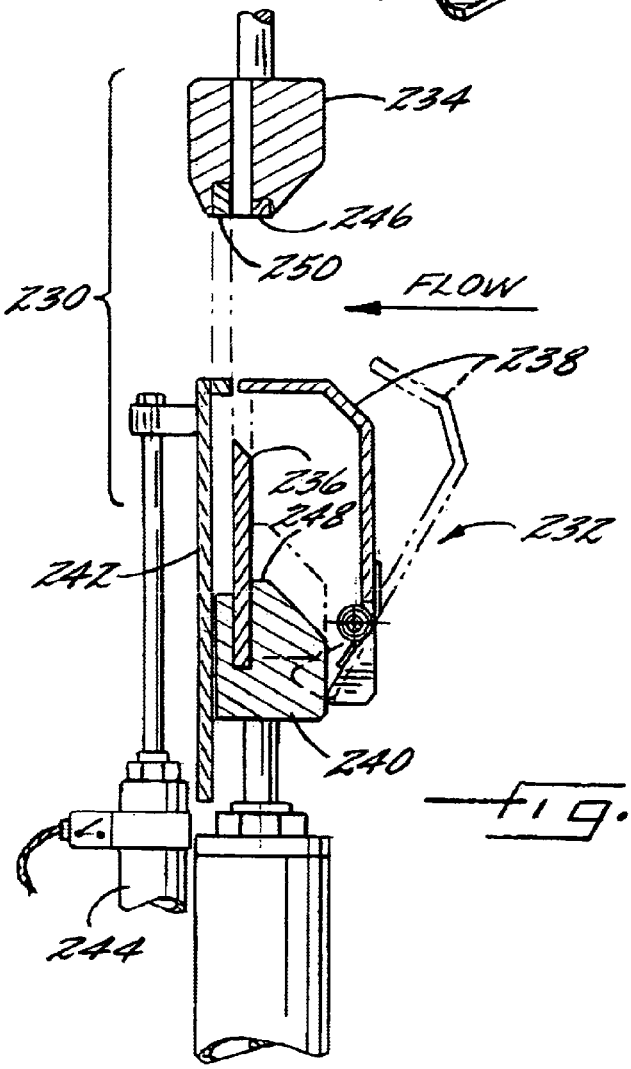

FIG. 19 is a cross-sectional view of the alternative cut-off device.

DETAILED DESCRIPTION OF PREFERRED EMBODIMENTS

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. Throughout the specification, where there are two of the same reference numbers one of which has a prime designation, the unprimed reference number refers to a component on the left side of the longitudinal centerline of the apparatus and the primed reference number refers to a corresponding component on the right side of the longitudinal centerline, as viewed in the downstream direction.

A packaging apparatus 20 in accordance with one embodiment of the invention is shown in FIG. 1. The apparatus 20 is of the dual-web type for advancing a first web 22 and a second web 24 in generally parallel opposing relation with an object disposed between the webs and sealing the webs together to capture the object therebetween. The apparatus includes a frame formed by a plurality of spaced vertical support columns 26, 28, 30, 32 on one side of a longitudinal axis of the apparatus, and a corresponding plurality of spaced vertical support columns 26', 28', 30', 32' on the opposite side of the longitudinal axis. A horizontal cross member 26" is rigidly connected between upper ends of the vertical columns 26, 26' at the upstream end of the apparatus, and a horizontal cross member 30" is rigidly connected between the upper ends of the vertical columns 30, 30' near the end of a product infeed portion of the apparatus. Longitudinal members 34 are rigidly connected between support columns 26 and 28, and similar longitudinal members 34' are rigidly connected between columns 26' and 28'. A longitudinal member 36 is rigidly connected between upper ends of the columns 26 and 30, and a longitudinal member 36' is rigidly connected between upper ends of the columns 26' and 30'. An infeed table support member 38 is rigidly connected between columns 28 and 30, and a similar infeed table support member (not shown) is connected between columns 28' and 30'. A longitudinal member 40 is rigidly connected between columns 30 and 32 at an outfeed end of the apparatus, and a similar longitudinal member (not shown) is connected between columns 30' and 32'.

Upstream columns 26 and 26' support supply rolls of the webs 22, 24 as further described below. The web 22 is drawn from its supply roll and advanced over a guide 42 supported between the columns 26, 26', then over a guide 44 supported between columns 30, 30', then down into the nip formed between a pair of opposed rolls 50, 52. The web 24 is drawn from its supply roll and advanced under a guide 46 supported between columns 28, 28', then under a guide supported between columns 30, 30', then up into the nip between opposed rolls 50, 52. The rolls 50, 52 press the webs 22, 24 against each other so the webs can be sealed together via sealing material carried on the facing surfaces of the webs. Objects to be packaged are fed into the nip between the webs 22, 24 by an infeed apparatus 54 supported atop the infeed table support members 38.

FIG. 2 shows an object O being fed into the nip between the rolls 50, 52 by the infeed apparatus 54. The infeed apparatus can be of various types. The illustrated apparatus includes an endless belt 56 driven by a suitable drive device (not shown). A plurality of pushers 58 are attached to the belt at regularly spaced intervals. The pushers 58 project up through a slot in a support table 60 on which objects O to be packaged are placed, with one object between each set of adjacent pushers. Thus, the pushers 58 push the objects toward the nip and the objects are fed one at a time into the nip. The movement of the infeed belt 56 can be continuous or intermittent and can be synchronized with the operation of the other elements of the apparatus 20 as will be understood by those skilled in the art. For purposes explained below, a height detector 62 located at the infeed station just upstream of the nip detects the height of the object O being fed into the nip.

With reference to FIGS. 1–3 and 7, the opposed rolls 50, 52 are rotatably mounted between a pair of supports 64, 64' affixed to the frame just downstream of the columns 30, 30'. As shown in FIG. 7, the roll 50 comprises a center shaft 68 having bearings 70 mounted on its opposite ends, the bearings 70 being removably received in support blocks 72 that define generally U-shaped slots or receptacles for receiving the bearings. Affixed to the shaft 68 are a pair of generally rigid annular drive rolls 74, 74' spaced on opposite sides of the longitudinal midpoint of the shaft; the shaft 68 passes through a central hole of each drive roll 74, 74' and is keyed or otherwise secured to the drive roll so that the drive rolls are forced to rotated with the shaft. The drive rolls 74, 74' are spaced apart from each other by a distance slightly less than the width of the packages being made. The drive rolls 74, 74' can be of various materials; in one embodiment they are aluminum and are coated with polyurethane so that they frictionally grip the webs 22, 24. Between the drive rolls 74, 74', a resiliently compliant roll portion 76 is affixed to the shaft 68. The resiliently compliant roll portion 76 is of annular form and the shaft extends through the central hole of the roll portion and is affixed thereto in suitable fashion so that the roll portion 76 is forced to rotate with the shaft. The resiliently compliant roll portion 76 may be formed of a polymer foam such as polyurethane foam or other suitable foam material. The roll 50 also includes a gear 78 mounted coaxially on the shaft 68.

The roll 52 is of essentially identical construction to that of the roll 50, having a center shaft 68, bearings 70, drive rolls 74, 74', resiliently compliant roll portion 76, and gear 78. The gears 78 of the two rolls 50, 52 are engaged with each other. The gear 78 of the lower roll 52 is also engaged by a drive gear 80 mounted on a shaft 82 that is rotatably journalled in the supports 64, 66. A sprocket 84 is also mounted on the shaft 82, and is driven by a drive belt 86 that in turn is driven by a drive motor 88. Thus, operation of the drive motor 88 drives the belt 86 and sprocket 84, which rotates the shaft 82 and drive gear 80, which rotates the rolls 50, 52 via the engagement of their gears 78.

As noted, the drive rolls 74, 74' are spaced apart slightly less than the width of the webs 22, 24, such that the edge portions of the webs are compressed and frictionally gripped between the opposed pairs of the drive rolls as best seen in FIG. 7. The rotation of the rolls 50, 52 thus pulls the webs 22, 24 through the apparatus. The drive rolls 74, 74' also form "hard" nips that firmly press the edge regions of the webs together to form longitudinal seals along the edges of the webs. Depending on the characteristics of the web materials, the drive rolls 74, 74' may not be required, as shown in the alternative embodiment of rolls 50*a*, 52*a* depicted in FIG. 8. Some web materials may be such that the compliant roll portions 76 alone provide sufficient friction to draw the webs through the apparatus without the need for drive rolls 74, 74', and/or there may be no need for longitudinal edge seals. More particularly, with stiffer web materials such as paperboard or the like, it is advantageous to form longitudinal edge seals, and in this situation the apparatus includes the drive rolls 74, 74'; however, with less stiff materials such a polymer films or the like, longitudinal edge seals may not be required, and hence the drive rolls can be omitted and the entire length of the rolls 50, 52 can be formed by the resiliently compliant roll portions as shown in FIG. 8. It will also be recognized by those skilled in the art that a separate drive arrangement for advancing the webs could be provided such that the rolls 50, 52 did not serve to advance the webs, in which case the drive rolls 74, 74' on the shafts 68 could be omitted and the rolls 50, 52 could be freewheeling rather than rotatably driven.

The primary functions of the rolls 50, 52 are: (1) to press the webs 22, 24 over the entire area of the object being packaged as well as in peripheral regions surrounding the perimeter of the object so that the webs conform closely to the object's contours and the webs are relatively free of wrinkles, and so that the webs are adhered together in the peripheral regions; and (2) to substantially center the packaged object O between the webs in the thickness direction so that the two webs are forced by the object's thickness to curve outwardly by about the same amount, thus leading to the overlying longitudinal edges of the webs being substantially aligned with each other. The webs are adhered or sealed together by a sealing material carried by the facing surfaces of the webs.

Advantageously, the sealing material comprises a cohesive, which readily adheres to itself by application of pressure but tends not to adhere to other surfaces. Thus, the webs do not stick to the object being packaged or to the components of the apparatus 20 with which the webs come into contact as they pass through the apparatus. The sealing material may be applied to a pre-manufactured web by any of various techniques, or the sealing material may be coextruded with the web during web manufacture.

The amount of compressive force the compliant roll portions 76 exert on the webs depends on several factors including the relative compressibility of the roll portions and the total thickness of the webs and object passing through the nip. The compressibility of the roll portions 76 can be controlled by suitably selecting the material of which the roll portions are made. For example, in the case of a polymer foam, the relative compressibility is generally a function of the density of the foam; denser foams are relatively less compressible (and thus exert greater pressure) than less dense foams. Polyurethane foam having a density of about 1 to 2 $lb/ft^3$ has been found to be suitable for various packaging materials, but foams of other density values could be used. It is desirable for the compliant roll portions 76 to be sized in diameter such that when the rolls 50, 52 are in nipping engagement the roll portions 76 are partially compressed where they engage each other so as to exert pressure on the webs in the peripheral regions surrounding the packaged object as the webs pass through the nip. It is also possible, as indicated by dashed lines in FIG. 8, for the resiliently compliant roll portion of one or both rolls to be formed as a plurality of segments arranged end-to-end such that each segment is deformable independently of the other segments.

Rolls 50, 52 having different characteristics can be used for different web materials. For instance, rolls providing greater pressure (e.g., denser foam) may be desirable with relatively stiffer or more rigid web materials such as cardboard, while rolls providing less pressure (e.g., less dense foam) may be desirable with relatively more flexible materials such as polymer film. Alternatively or additionally, rolls having a different spacing between the hard drive rolls 74, 74' may be desirable for use with web materials of different widths, or rolls entirely lacking the hard drive rolls may be desired. To facilitate exchanging rolls 50, 52 of one type for rolls of another type, the rolls 50, 52 are releasably mounted in the blocks 72 as shown in FIG. 7. The bearings 70 of the top roll 50 are pressed downwardly into the U-shaped receptacles in the mounting blocks 72 by a pair of quick-release clamps 90. By releasing the clamps 90, the top roll 50 can be lifted out of the mounting blocks 72. The bottom roll 52 can then be lifted out of its mounting blocks 72. Replacement rolls are installed by reversing this procedure. Changing rolls thus is a very quick operation.

After the object O passes through the nip between the rolls 50, 52, the object reaches the side seal station where side seals are formed to prevent the object from shifting laterally within the package. If the object were to shift too close to one side of the package, the object could be damaged in the event the package were dropped on a corner of the package. Although the rolls 50, 52 press the webs together in peripheral regions surrounding the packaged object, it will be appreciated that particularly with stiffer web materials the rolls may not be capable of pressing and sealing the webs firmly together close to the opposite edges of the object, particularly if the object has a substantial thickness (e.g., a book). Accordingly, side seals are made close to the object to prevent the object from shifting laterally. FIGS. 9–13 illustrate the structure and operation of the side seal arrangement of the apparatus and FIG. 9 shows the side seal arrangement 100. The side seal arrangement 100 includes two side seal devices 102, 102' arranged on opposite sides of the longitudinal axis of the apparatus 20. Each side seal device is operable to press the webs 22, 24 together, and is movable transversely inward toward the longitudinal centerline and outward away from the longitudinal centerline. In the illustrated side seal arrangement, each side seal device includes a pair of roller balls 106 arranged to form a nip through which the webs 22, 24 pass. Each ball 106 is captively retained in a housing 108 so that the ball is freely rotatable in all directions and the ball can be depressed into the housing against the force of a spring, which urges the ball toward the opposite ball of the pair.

Transverse movement of the side seal devices 102, 102' is effected by a traversing mechanism. A separate traversing mechanism could be used for each side seal device. However, in the illustrated embodiment, the two side seal devices are traversed inward and outward in synchronism with each other by a single traversing mechanism. To this end, each roller ball housing 108 is mounted on a carriage. The two carriages 110, 110' carrying the balls 106 that contact the web 24 are affixed to an endless belt 112 that extends transversely from one side of the apparatus to the other. The belt 112 is driven by a motor 114 operable to drive the belt alternatively in one direction or the opposite direction, such as a reversible electric stepper motor. The belt is looped about a drive pulley 116 on one side of the longitudinal centerline and an idler pulley 118 on the other side of the centerline. The carriage 110 is affixed to a downstream portion of the belt 112, while the carriage 110' is affixed to an upstream portion of the belt; accordingly, when the motor 114 rotates in a direction to cause the carriage 110 to move transversely inward toward the longitudinal centerline, the carriage 110' is also moved transversely inward, and conversely both carriages are moved outward when the motor rotates the opposite direction.

The two carriages 120, 120' that carry the roller balls that contact the web 22 are respectively affixed to the corresponding carriages 110, 110' by brackets 122, 122' so that the carriage 120 is forced to travel with the carriage 110 and the carriage 120' is forced to travel with the carriage 110'. The brackets 122, 122' are generally C-shaped with a deep channel for accommodating the webs 22, 24 so that the side seal devices 102, 102' can be moved inward near the object being packaged as shown in FIG. 11.

The inward and outward movement of the side seal devices 102, 102' is synchronized with the advancement of the object O through the nip of the rolls 50, 52. As will be understood by those skilled in the art, a central controller C (FIG. 10) can be connected with the main drive motor 88 for the rolls 50, 52 and with the motor 114 for the side seal devices, as well as with the infeed apparatus 54 and with encoders and/or other suitable position feedback devices or sensors associated with each of these devices so that the controller can determine when to activate the side seal device motor 114 to drive the side seal devices 102, 102' inward so that side seals are made that approach the opposite side edges of the object being packaged.

The side seal devices may be moved first inward and then outward while the webs 22, 24 and the object O are being advanced, resulting in side seals being formed that begin near the opposite longitudinal edges of the webs, slant inward toward the packaged object, and then back toward the longitudinal edges. The inward movement of the side seal devices is halted when the side seal devices come within close proximity to the object. This close proximity can be detected in various ways. For instance, the motor 114 can include an encoder for providing an indication of how far the side seal devices have been advanced, which can be used in conjunction with a known object width to determine how close the side seal devices are to the object's edges. Alternatively, the electric current supplied to the motor 114 may be monitored; when the side seal devices come close to the object, the resistance to their further inward movement is increased by the divergence of the webs over and under the object, and the increased resistance means greater current must be supplied to the motor. Thus, when the current exceeds a predetermined threshold indicating close proximity to the object, the side seal devices are halted. After a predetermined amount of advancement of the webs, the side seal devices are then retracted back to their starting points near the edges of the webs. Depending on the speed of advancement of the webs relative to that of the side seal devices, side seals of different contours can be made. FIGS. 12 and 13 illustrate two possible contours of side seals 124, 124' that can be made. The side seals together describe a generally hourglass shape.

Alternatively, as previously noted, the side seals can instead be linear in the longitudinal direction. To this end, the side seal devices can be moved to the appropriate locations and held there throughout the packaging operation, the locations being changed only when the width of the packaged objects changes. The side seal devices could be manually adjustable in position, or could be automatically driven to the appropriate positions by a suitable drive mechanism such as that already described. The positioning of the side seal devices could be controlled in response to a detected width of the packaged object using a suitable controller and width detector, or the width of the objects could be entered by an operator via a keyboard or the like. All of these variations fall within the general concept of forming side seals that are spaced inward of the web's longitudinal edges and are closely adjacent the side edges of the packaged object to prevent substantial lateral shifting of the object within the package.

Downstream of the side seal arrangement 100 is a sealing and cut-off device 130 that forms cross seals along the trailing edge of one package and along the leading edge of the adjacent package and severs the webs along a line between the two cross seals, thus cutting the webs into discrete packages. FIGS. 14–16 show the sealing and cut-off device and its operation. The device includes a base plate 132 that is fixedly mounted to the frame of the apparatus 20. A pair of parallel guide rods 134, 134' are affixed to the plate 132 on opposite sides of the longitudinal centerline of the apparatus. A generally stationary sealing bar 136 having apertures for receiving the guide rods is mounted on the guide rods adjacent the side of the plate 132 facing the webs. The bar 136 is attached to the rod of a pneumatic spring 138 mounted on the opposite side of the plate 132. The pneumatic spring 138 allows the bar 136 to "give" slightly when a sealing and cut-off operation is being performed, but the bar 136 undergoes only slight movement and thus is generally stationary.

A reciprocating sealing and cut-off assembly 140 is slidably mounted on the guide rods 134, 134' so as to be movable toward and away from the generally stationary sealing bar 136. The sealing and cut-off assembly 140 is connected to the rods of a pair of cylinders 142, 142' spaced on opposite sides of the longitudinal centerline of the apparatus. Retraction of the cylinder rods 144, 144' causes the sealing and cut-off assembly 140 to move toward the generally stationary sealing bar 136 and engage the webs 22, 24 therebetween as shown in FIG. 16; extension of the rods causes the sealing and cut-off assembly to move away from the sealing bar 136 as shown in FIG. 15.

The sealing and cut-off assembly 140 includes a bar 146 having a channel formed therethrough. A cut-off blade or knife 148 is received in the channel and is fixed in position relative to the bar 146 by fasteners 150 passing through apertures in the bar and in the knife. Also received in the channel in the bar 146 is a movable guard and sealing plate 152 that is movable over a limited range of motion in the direction in which the sealing and cut-off assembly 140 reciprocates. The movable guard and sealing plate 152 includes openings 154 that are elongated in the direction of reciprocation, and the fasteners 150 for fixing the knife 148 pass through the openings 154. When the sealing and cut-off assembly 140 is in its retracted position as in FIG. 15, the guard and sealing plate 152 is relatively closer to the sealing bar 136 and extends beyond the edge of the knife 148 so as to prevent inadvertent contact with the edge of the knife 148. The guard and sealing plate 152 will remain in this position relative to the knife during advancement of the sealing and cut-off assembly 140 until the plate 152 contacts the webs against the generally stationary sealing bar 136. The sealing and cut-off assembly 140 then continues advancing to cause the knife 148 to sever the webs as shown in FIG. 16 (the generally stationary sealing bar 136 having a recess for receiving the edge of the knife), and the guard and sealing plate 152 reaches the limit of its travel relative to the knife 148 just as the knife cuts through the entire width of the webs, and then is urged against the generally stationary sealing bar 136. A sealing surface 156 on the guard and sealing bar 152 cooperates with a surface on the sealing bar 136 to form a cross seal 158 (FIG. 16 on the downstream side of the line along which the webs are cut. At the same time, a sealing surface 160 on the sealing bar 136 cooperates with a surface on the bar 146 to form a cross seal 162 upstream of the cut line. The sealing and cut-off assembly 140 is then retracted by extending the cylinder rods 144, 144' and the assembly 140 returns to its starting position; the guard and sealing plate 152 extends relative to the knife as the assembly is retracted The sealing surfaces 156, 160 can be serrated or otherwise contoured as desired.

The sealing and cut-off device 130 also includes an additional guard assembly 170 just downstream of the cutting location to prevent someone from inserting a hand or other object into the cut-off device during a cutting operation. The guard assembly 170 includes a guard 172 slidably mounted on a pair of guide rods 174, 174' spaced on opposite sides of the longitudinal centerline of the apparatus. The guard 172 is connected to the rods of a pair of pneumatic cylinders 176, 176' affixed to the frame of the apparatus. Just before the cut-off device is operated to sever the webs, the cylinders 176, 176' are activated to move the guard 172 into a position blocking the opening between the reciprocating and stationary parts of the cut-off device. The guard 172 is moved until it is closely adjacent the package that has just exited the cut-off device, and then the cutoff device cuts the package from the remainder of the webs.

Instead of a blade or knife, the cut-off device can use other types of cutting members. For instance, a shear bar arrangement that works on a principle similar to scissors could be used.

Downstream of the cut-off device 130 is an outfeed device 180 for moving completed packages away from the cut-off device. Any suitable type of outfeed device can be used, or the outfeed device can be omitted in the case of an apparatus that produces packages one at a time for manual removal. The illustrated outfeed device 180 is a conveyor comprising a wide endless belt 182 looped about an upstream idler roller 184 and a downstream drive roller 186. The drive roller 186 is driven by a belt 188 that in turn is driven by the main drive motor 88 through a gearbox and drive pulley assembly. Thus, the outfeed device 180 and the rolls 50, 52 are driven in synchronization with one another since they are all driven by the same motor 88.

An alternative embodiment of a sealing and cut-off device 230 is shown in FIGS. 18 and 19. The device includes a sealing and cut-off assembly 232 located adjacent the web 24 and a seal bar 234 adjacent the other web 22. The sealing and cut-off assembly 232 and the seal bar 234 are moved toward each other to sever and seal the webs. The assembly 232 includes a knife 236 that is received into a recess in the seal bar 234 during a cutting operation. A pivoting guard 238 is mounted adjacent the sealing and cut-off assembly 232 in its retracted or "home" position such that the guard shields the knife to prevent inadvertent contact with it. The guard is contacted by the bar 240 in which the knife is mounted so as to hold the guard in its shielding position (as shown in solid lines in FIG. 19) when the bar 240 is retracted to its home position. A second guard 242 is located on the opposite (downstream) side of the knife 236; the two guard 238, 242 together substantially completely enclose the knife in the retracted position of the bar 240. The guard 242 is reciprocated by a pair of pneumatic cylinders 244, 244'. At the start of a cutting operation, the guard 242 is raised until the webs are pressed between the guard 242 and the bar 234. Position sensors associated with the cylinders 244, 244' determine the thickness of the material between the guard 242 and the seal bar 234; if the thickness is substantially greater than the expected thickness of the combined webs, that is an indication that a foreign object is present, and the cut-off device 230 is disabled. However, if the determined thickness matches the expected web thickness, the sealing and cut-off assembly 232 is actuated to move toward the seal bar 234; as the bar 240 moves, the pivoting guard 238 is pivoted away by a spring or the like so that the bar 240 can clear the guard and the knife can sever the webs. The bar 240 is then retracted back to its starting position, which moves the guard 238 back to its shielding position, and the guard 242 is retracted back to its starting position to complete the cut-off operation. Cross seals are made in the webs by cooperating sealing surfaces on the seal bar 234 and the bar 240 and guard 242. More particularly, a surface 246 on the seal bar 234 cooperates with a surface 248 on the bar 240 to form a cross seal upstream of the cut line along which the webs are severed. The guard 242 is urged by the bar 240 to press the webs against a surface 250 on the seal bar 234 to form a cross seal downstream of the cut line. The surfaces 246, 250 can be serrated or otherwise contoured as desired.

The apparatus 20 may also include other unique features. As noted, a height detector 62 (FIG. 2) detects the height of an object being fed into the nip of the rolls 50, 52. The measured height of the object in may be used by the central controller C (FIG. 10) to set the "fin length" of the package. By "fin length" is meant the distance d in the longitudinal direction between the edge of the packaged object and the edge of the package, as shown in FIG. 16. In general, it is desirable to increase the fin length d as the height of the object increases. The controller controls the fin length by advancing the webs by a relatively greater or lesser distance (referred to herein as the index distance) between cutting operations. The index distance will also be a function of the length of the objects being packaged. The object length can be supplied as an input to the controller. In general, the overall package length, which is equal to the index distance, is equal to the object length plus twice the fin length d. Thus, given the object length and the measured object height, the controller can determine the proper index distance to achieve the desired fin length. Alternatively, the height of the packaged object can be input to the controller by an operator rather than being measured by a detector, or the necessary package length or index distance to achieve the desired fin length can be calculated ahead of time and can be input to the controller.

When packaging some types of objects such as hardcover books, protection of the object during shipping is of great importance so that the object arrives at its destination in good condition. For instance, it would be undesirable for an expensive hardcover book to be damaged by being dropped on a corner. The present invention provides the ability to make packages that afford enhanced protection to prevent such occurrences. This is accomplished in part by the side seals 124, 124'. As illustrated in FIG. 4, the side seals keep the packaged object centered in the package rather than shifting close to an edge of the package. Were the package to be dropped on a corner as shown while the object is close to the corner, damage to the object could ensue. With the object packaged in accordance with the invention, however, the object remains spaced from the package edge so that the package takes the brunt of the impact.

The enhanced protection is also facilitated by enhanced package stiffness. This is relevant particularly when using relatively stiff web materials such as paperboard. It has been found that the corner regions of a package having side seals in accordance with the invention are stiffened relative to an otherwise identical package not having the side seals.

Another feature of the apparatus 20 has to do with the mounting of the web supply rolls. In general it is desirable to impart some resistance to the turning of the supply rolls so that a relatively uniform draw-off tension exists in the webs and so that slack is not created by the rolls continuing to turn when the webs are not being advanced. The draw-off tension can affect the quality of the packages, and hence it is desirable for the tension to be maintained at or near an optimum level, which may depend on the characteristics of the web materials and other factors. Because the optimum tension tends to vary with different web materials, it is desirable for the tension to be readily adjustable. The web supply roll mounting arrangement shown in FIGS. 5 and 6 accomplishes these desires. The mounting arrangement for the web 22 is shown; the arrangement for the other web is similar. The mounting arrangement includes a shaft 260 for insertion up through the hollow core of the supply roll. A removable plug 262 receives one end of the shaft and is inserted into one end of the supply roll core so as to frictionally grip the core; the plug 262 engages the shaft such that the plug and shaft rotate as a unit, and the supply roll also rotates with the shaft and plug by virtue of the plug's frictional engagement in the core. A similar plug 264 is mounted on the shaft near the opposite end thereof for frictionally engaging the other end of the core. The end of the shaft extending beyond the plug 262 is releasably retained in a bearing arrangement 266 affixed to the support column 26'. The bearing arrangement 266 includes a cradle for cradling the end of the shaft so that the shaft is freely rotatable, and a latch member 268 that pivots between a closed position preventing the shaft from being lifted out of the cradle and an open position allowing the shaft to be lifted out. FIG. 5 shows the latch member in the closed position; it is held in the closed position by a quick-release over-center latch 270.

A brake wheel 272 is mounted on the opposite end of the shaft. The brake wheel is releasably retained in a clamp arrangement 274 affixed to the support column 26. The clamp arrangement 274 includes a cradle or receptacle for receiving the brake wheel so that the wheel is rotatable, and a clamp member 276 that pivots between a closed position and an open position. The surface of the clamp member 276 facing the brake wheel carries a brake shoe 278 of suitable friction material. In the closed position of the clamp member 276, the brake shoe 278 engages the brake wheel. The clamp member is held closed by a quick-release over-center latch 280 having a catch 282 fixed to the cradle and a hook 284 fixed to the clamp member 276. The clamping force of the clamp arrangement is adjustable so as to adjust the amount of frictional braking of the supply roll, and hence the web tension. To this end, the hook 284 is adjustable in position by an adjustment knob 286 attached to a threaded shaft that is engaged in a threaded hole (not shown) in the hook 284; the hook is prevented from rotating with the shaft by a housing on the clamp member in which the hook is mounted. Turning the knob in one direction causes the hook to be moved closer to the catch 282 so that less clamping force is produced when the latch 280 is closed; turning the knob the other direction increases the clamping force.

To change a supply roll, the quick-release latches 270, 280 are opened and the roll and shaft 268 are lifted out of the receptacles. The plug 262 is removed from the shaft and the shaft is withdrawn from the supply roll core, the shaft is inserted into a new supply roll and the plug 262 is replaced, and the roll and shaft are lowered into the receptacles. The latches 270, 280 are then closed to complete the operation. Advantageously, the adjustment of the knob 286 is not disturbed by the roll-change procedure. Thus, the amount of frictional braking should remain unchanged.

Many modifications and other embodiments of the inventions set forth herein will come to mind to one skilled in the art to which these inventions pertain having the benefit of the teachings presented in the foregoing descriptions and the associated drawings. For example, although only a dual-web apparatus 20 is shown and described, it will be recognized by persons skilled in the art that the present invention is equally applicable to an apparatus that creates a package from a single web that is provided in C-fold form or is manipulated to be in C-fold form such that there are two web portions in parallel opposing relation that are sealed together with the packaged object therebetween.

Additionally, in the illustrated apparatus 20 both rolls 50 and 52 have resiliently compliant roll portions. However, only one of the rolls may comprise a compliant roll portion while the other roll may be substantially noncompliant. Having both rolls compliant is advantageous in that the rolls tend to center the packaged object with respect to the webs in the thickness direction, and thus each of the webs bends and curves to accommodate effectively half the thickness of the object. If only one roll were compliant, the web adjacent the noncompliant roll would tend to remain flat and the other web would be forced to bend and curve to accommodate the full thickness of the object.

Furthermore, the side seal devices 102, 102' are illustrated and described as comprising roller balls retained in carriages that are mechanically connected to each other, but other types of side seal devices could be used; any device capable of being positioned close to the packaged object and capable of pressing the webs together to form side seals preventing the object from laterally shifting may be suitable. For instance, wheels or rollers could be used instead of balls, the carriages could be linked magnetically rather than mechanically, actuators other than electric motors (e.g., fluid cylinders, ball screw-type devices, etc.) could be used for moving the side seal devices, etc.

The previously enumerated alternatives are by no means exhaustive; other modifications and substitutions of equivalents can be made. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for packaging an item, comprising:

a pair of opposed rolls forming a nip therebetween; and a web supply system for supplying a pair of generally parallel opposing web portions of flexible packaging material into the nip so that an item to be packaged when placed between the web portions is passed through the nip along with the web portions, facing surfaces of the web portions having sealing material for sealing the web portions together;

wherein at least one of the rolls extends across the full width of the web portions and is rotatably driven by a drive system and includes a resiliently compliant roll portion that is deformed by the item passing through the nip, the resiliently compliant roll portion tending to return to its undeformed shape thereby exerting pressure on the web portions to closely conform to the item.

2. The apparatus of claim 1, wherein each of the rolls includes said resiliently compliant roll portion and each is rotatably driven by the drive system.

3. The apparatus of claim 2, wherein each resiliently compliant roll portion comprises a resiliently deformable foam.

4. The apparatus of claim 2, wherein each roll includes a substantially rigid core and a resiliently deformable foam cover surrounding the core to form said resiliently compliant roll portion.

5. The apparatus of claim 4, wherein at least one foam cover comprises a plurality of generally cylindrical segments arranged end-to-end, the segments being deformable independently of one another.

6. The apparatus of claim 3, wherein the foam is a polyurethane foam.

7. The apparatus of claim 2, further comprising drive rolls for advancing the web portions through the nip.

8. The apparatus of claim 7, wherein the drive rolls comprise opposite end portions of the rolls that have the resiliently compliant roll portions, the opposite end portions being substantially less compliant than the resiliently compliant roll portions.

9. The apparatus of claim 1, further comprising a pair of side seal devices respectively arranged at locations closely adjacent but spaced from opposite sides of the item being packaged and spaced inwardly of the longitudinal edges of the web portions, the side seal devices being operable to seal the web portions together at said locations to form side seals that prevent the item from shifting transversely toward either longitudinal edge of the web portions.

10. The apparatus of claim 9, wherein each side seal device comprises a pair of opposed contact members to press the web portions together.

11. The apparatus of claim 10, wherein the side seal devices are adjustable in position in the transverse direction of the web portions for accommodating items of different widths.

12. The apparatus of claim 11, wherein the contact members comprise balls mounted to roll freely along the web portions.

13. The apparatus of claim 11, wherein each of the side seal devices is carried transversely inward and outward by a traversing device.

14. The apparatus of claim 13, wherein the traversing device is operable to detect when the contact members of each side seal device are closely adjacent to but spaced from the item being packaged.

15. The apparatus of claim 14, wherein the traversing device includes an electric motor for moving the contact members inward and outward, and the traversing device is operable to monitor current supplied to the electric motor and to stop inward movement of the contact members when the current reaches or exceeds a predetermined threshold value.

16. The apparatus of claim 14, wherein the traversing device monitors transverse position of the contact members.

17. The apparatus of claim 1, wherein the web supply system includes a core shaft for engaging a core of a supply roll of web material such that the supply roll is constrained to rotate with the core shaft, the core shaft having a brake wheel mounted thereon, the web supply system further comprising a quick-change mounting system including a brake shoe urged against the brake wheel by a clamp having a quick-release latch.

18. The apparatus of claim 17, wherein the quick-release latch has an adjustable member whose setting is changeable for adjusting a clamping force of the clamp and wherein the latch is openable and closable without changing the setting of the adjustable member.

19. The apparatus of claim 1, further comprising a cut-off device for severing a completed package from the web portions, and a safety system including a detector for detecting presence of a foreign object in the path of the cut-off device, the safety system being operable to disable the cut-off device upon the detector detecting such a foreign object.

20. The apparatus of claim 19, wherein the detector includes a member proximate the cut-off device that is moved toward the web portions into a first position when no foreign object is present but that is blocked by a foreign object from moving into said first position, thus indicating presence of the foreign object.

21. An apparatus for packaging an item, comprising:

a web supply and drive system for supplying and advancing two web portions of a flexible packaging material such that the web portions are opposing each other at an item-receiving station at which an item to be packaged is placed between the opposing web portions;

a cut-off device downstream of the item-receiving station, the cut-off device being structured and arranged to sever the web portions along a cut line to separate a package from the remainder of the web portions;

a height detector for detecting a height dimension of the item being packaged; and a controller connected to the web supply and drive system, to the height detector, and to the cut-off device, the controller being operable to coordinate operation of the cut-off device and the web supply and drive system so as to automatically cause the cut line to be spaced from an adjacent edge of the item by a variable spacing distance that is a function of a height dimension of the item detected by the height detector.

22. The apparatus of claim 21, wherein the web supply and drive system includes drive rolls rotatably driven by a drive motor for advancing the web portions, the controller being operable to cause the drive motor to intermittently advance the web portions and bring them to a halt for cut-off.

23. The apparatus of claim 22, wherein the drive rolls comprise a pair of rolls extending across the full width of the web portions and forming a nip therebetween through which the web portions pass, wherein at least a portion of at least one of the rolls comprises a resiliently compliant roll portion that is deformed by the item passing through the nip and that presses the adjacent web portion against the item and presses the web portions together surrounding the item.

24. The apparatus of claim 23, wherein at least a portion of each of the rolls comprises a resiliently compliant roll portion.

25. The apparatus of claim 21, wherein the web supply and drive system is arranged to draw two separate webs from respective supply rolls and bring the webs into generally parallel opposing relation at the item-receiving station.

26. The apparatus of claim 21, wherein the web supply and drive system includes a quick-change mounting system for a supply roll, the quick-change mounting system including a core shaft configured to be inserted into and engage a core of a supply roll such that the supply roll is constrained to rotate with the core shaft, an end of the core shaft having a brake wheel mounted thereon, the quick-change mounting system including a receptacle for receiving and rotatably supporting the brake wheel and having a brake shoe, the brake shoe being urged against the brake wheel by a clamp so as to resist rotation of the supply roll and thereby control draw-off tension of the web, the clamp including a quick-release latch.

27. The apparatus of claim 26, wherein the quick-release latch includes an adjustment control for adjusting a clamping force of the clamp.

28. The apparatus of claim 27, wherein the adjustment control is structured and arranged such that a selected adjustment position of the adjustment control is maintained during unlatching and re-latching of the latch.

29. An apparatus for packaging an item, comprising:

a pair of opposed rolls forming a nip therebetween;

a web supply system for supplying a pair of generally parallel opposing web portions of flexible packaging material into the nip so that an item to be packaged when placed between the web portions is passed through the nip along with the web portions, facing surfaces of the web portions having sealing material for sealing the web portions together;

wherein at least one of the rolls includes a resiliently compliant roll portion that is deformed by the item passing through the nip, the resiliently compliant roll portion tending to return to its undeformed shape thereby exerting pressure on the web portions to closely conform to the item; and a pair of side seal devices respectively arranged at locations closely adjacent but spaced from opposite sides of the item being packaged and spaced inwardly of the longitudinal edges of the web portions, the side seal devices being operable to seal the web portions together at said locations to form side seals that prevent the item from shifting transversely toward either longitudinal edge of the web portions, wherein each side seal device comprises a pair of opposed contact members to press the web portions together, the contact members comprising balls mounted to roll freely along the web portions.

30. An apparatus for packaging an item, comprising:

a pair of opposed rolls forming a nip therebetween;

a web supply system for supplying a pair of generally parallel opposing web portions of flexible packaging material into the nip so that an item to be packaged when placed between the web portions is passed through the nip along with the web portions, facing surfaces of the web portions having sealing material for sealing the web portions together;

wherein each of the rolls includes a resiliently compliant roll portion that is deformed by the item passing through the nip, the resiliently compliant roll portion tending to return to its undeformed shape thereby exerting pressure on the web portions to closely conform to the item, each roll having opposite end portions between which the resiliently compliant roll portion is disposed, the opposite end portions of the rolls comprising drive rolls that are substantially less compliant than the resiliently compliant roll portions and that engage opposite longitudinal edge portions of the web portions passing through the nip; and a drive system coupled with the rolls for rotatably driving the rolls, the opposite end portions of the rolls serving to advance the web portions through the nip.

31. An apparatus for packaging an item, comprising:

a pair of opposed rolls forming a nip therebetween;

a web supply system for supplying a pair of generally parallel opposing web portions of flexible packaging material into the nip so that an item to be packaged when placed between the web portions is passed through the nip along with the web portions, facing surfaces of the web portions having sealing material for sealing the web portions together;

a pair of side seal devices respectively arranged at locations closely adjacent but spaced from opposite sides of the item being packaged and spaced inwardly of the longitudinal edges of the web portions, the side seal devices being operable to seal the web portions together at said locations to form side seals that prevent the item from shifting transversely toward either longitudinal edge of the web portions; and motor-driven traversing devices supporting the side seal devices, wherein the traversing devices are operable to move the side seal devices transversely toward and away from the longitudinal edges of the web portions for adjusting transverse positions of said locations at which the web portions are sealed together.

* * * * *